United States Patent [19]

Young

[11] Patent Number: 4,773,200

[45] Date of Patent: Sep. 27, 1988

[54] WOODEN SUSPENDED CEILING SYSTEM

[76] Inventor: Jerry V. Young, 1200 S. Lee, Morton, Ill. 61550

[21] Appl. No.: 140,973

[22] Filed: Jan. 5, 1988

Related U.S. Application Data

[63] Continuation of Ser. No. 893,703, Aug. 6, 1986, abandoned.

[51] Int. Cl.[4] ..... E04B 5/52

[52] U.S. Cl. ..... 52/484; 52/664; 52/780

[58] Field of Search ..... 52/484, 485, 664, 665, 52/780

[56] References Cited

U.S. PATENT DOCUMENTS

| | | | |
|---|---|---|---|
| 2,971,617 | 2/1961 | Smith et al. | 189/85 |
| 2,994,113 | 8/1961 | Dail | 20/4 |
| 3,013,644 | 12/1961 | Smith et al. | 189/85 |
| 3,329,387 | 7/1967 | Fischer | 248/342 |
| 3,385,021 | 5/1968 | Nys | 52/665 |
| 3,557,506 | 1/1971 | Pechenik | 52/309 |
| 3,583,119 | 6/1971 | Kann | 52/311 |
| 3,783,771 | 1/1974 | Hartzell et al. | 98/40D |
| 3,785,110 | 1/1974 | Galloway et al. | 52/715 |
| 3,835,614 | 9/1974 | Downing | 52/484 |
| 4,019,300 | 4/1977 | Sauer | 52/665 |
| 4,040,758 | 8/1977 | Sauer | 403/397 |
| 4,047,348 | 9/1977 | McSweeney | 52/484 |
| 4,281,498 | 8/1981 | Kern | 52/780 |
| 4,367,616 | 1/1983 | Pearson | 52/664 |
| 4,452,021 | 6/1984 | Anderson | 52/311 |
| 4,454,700 | 6/1984 | Kern | 52/665 |
| 4,464,876 | 8/1984 | Kern | 52/484 |
| 4,525,971 | 7/1985 | Kern | 52/484 |

FOREIGN PATENT DOCUMENTS

| | | | |
|---|---|---|---|
| 15979 | 1/1898 | Switzerland | 52/456 |
| 24948 | of 1899 | United Kingdom | 52/780 |

*Primary Examiner*—James L. Ridgill, Jr.

*Attorney, Agent, or Firm*—Polster, Polster and Lucchesi

[57] ABSTRACT

A wooden suspending ceiling system is disclosed comprising a plurality of parallel wooden runners extending in one direction, and a plurality of parallel wooden cross members supported by the runners and extending in a second direction perpendicular to the runners defining a generally rectangular grid system having a plurality of openings therein. Ceiling panels, lighting fixtures, or air vents are supported by the runners and cross members defining the rectangualr grid system and closing the openings therein. The runners and the cross members have an upper face and a bottom face, with the bottom face being viewable from below. The upper face of both the runner and cross members comprises a central portion with a groove on each side of the central portion, and with a lip outboard of each of the grooves. The inner surface of the lip defines the outer surface of the groove on each side of the central portion, and with a lip outboard of each of the grooves. The inner surface of the lip defines the outer surface of the groove, and the outer surface of each of the lips defines a vertical side of the runner or cross member. The cross member has an integral hook extending out beyond each end thereof for cooperating with an adjacent side, lip, and groove of a respective runner thereby to positively interconnect the cross member to the runners and to support the cross members on the runners.

11 Claims, 3 Drawing Sheets

FIG. 1.
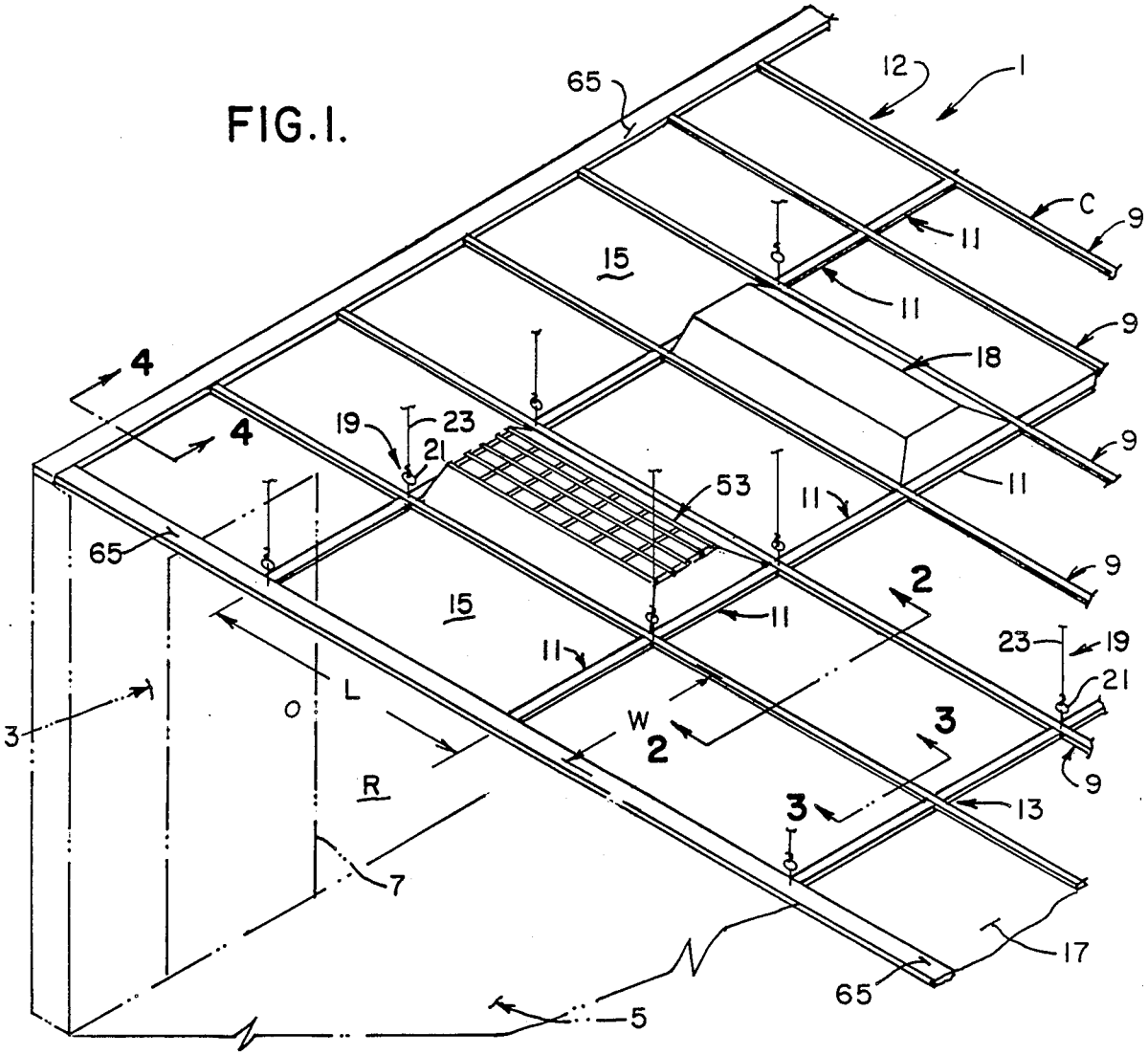
FIG. 2.
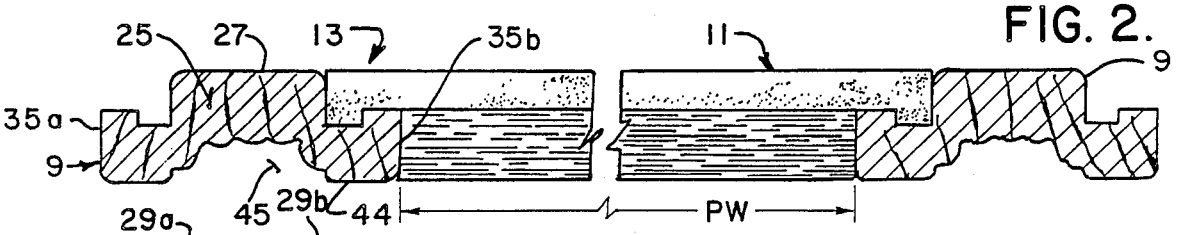
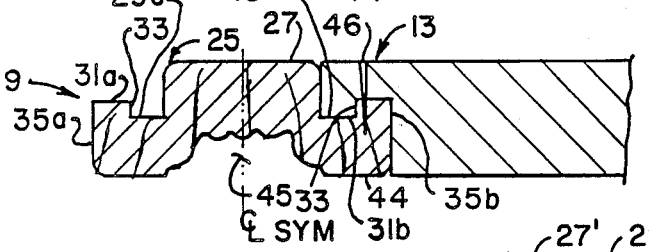
5 5
FIG. 3.
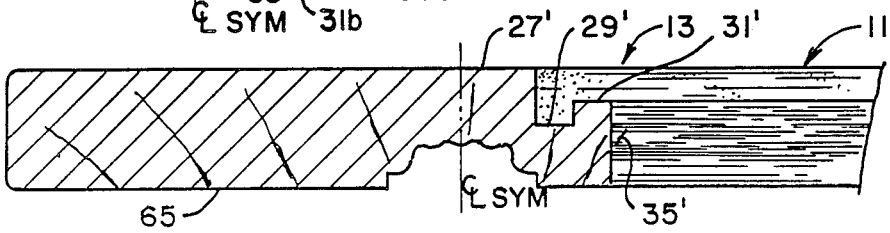
FIG. 4.

WOODEN SUSPENDED CEILING SYSTEM

This is a continuation application of copending application Ser. No. 893,703 filed on Aug. 6, 1986, now abandoned.

BACKGROUND OF THE INVENTION

This invention relates to a wooden suspended ceiling system, and more specifically to the grid system of such a wooden suspended ceiling system for supporting ceiling panels, lighting fixtures, or air vents in a suspended ceiling.

Generally, in modern office buildings, each floor of the building, prior to being subdivided and occupied by tenants, consists of a finished floor and a continuous, suspended ceiling having a plurality of fluorescent (or other) lighting fixtures spaced in the ceiling at desired intervals. Additionally, heating, ventilating, and air conditioning (HVAC) outlets are provided at desired spaced locations within the suspended ceiling system. The suspended ceiling typically comprises a metal grid consisting of longitudinal parallel runners spaced apart from one another a desired distance, separated by cross members at desired intervals with the runners and cross members being perpendicular to one another and defining a plurality of generally rectangular openings between the perpendicular runners and cross members. These openings are of a standardized size (e.g., two feet×two feet) such that modularized ceiling panels, lighting fixtures, or ventilation outlets may be dropped in place within the openings of the grid systems at desired locations and supported by the ceiling grid system. Typically, the ceiling grid system is suspended below the roof or floor immediately thereabove by means of suspension wires interconnecting the grid system to the structure thereabove, with the suspension wires being adjusted in such manner so as to ensure that the ceiling is suspended in a level position at a desired height above the floor below. Typically, in modern commercial buildings, a sufficient space is provided between the suspended ceiling and the structure thereabove so as to permit HVAC ducts, electrical wiring, plumbing pipes, etc., to readily be mounted between the suspended ceiling and the floor or ceiling structure thereabove.

Upon constructing a new office building, once a tenant leases or occupies the space, partitions within the building, typically consisting of vertical metal studs faced with dry wall sheathing on each side thereof, are erected on the floor at desired locations and are secured to the floor so as to sub-divide the space into a desired interior arrangement. Suitable doors and other fixtures are incorporated in the wall partitions. However, the partitions are typically not connected to the suspended ceiling and, in fact, the suspended ceiling may, at least in part, rest or bear on the upper surfaces of the partitions. In the event one wishes to change the floor plan of the building, it is a relatively simple and inexpensive matter to remove the partitions and to erect others without having any effect on the suspended ceiling system. Oftentimes, it is a relatively easy matter to relocate lighting fixtures and air vents within the ceiling grid structure so that rooms defined by the subsequently erected wall partitions serve desired occupied areas or rooms within the building.

Reference may be made to such patents as U.S. Pat. Nos. as 2,971,617, 2,994,113, 3,013,644, 3,329,387, 3,385,021, 3,783,771, 3,785,110, 4,019,300, 4,040,758, and 4,047,348, which show a variety of conventional prior art suspended ceiling systems utilizing intersecting, perpendicular metal grid members. While these prior art suspended ceiling systems worked well for their intended purposes, and while they were of rigid construction and were relatively easy to interconnect with one another, the bottom faces of the grid members were typically readily viewable from below by occupants within a room.

Typically, the ceiling panels utilized with such typical prior art metal grid systems were of a fibrous composition material, and were so manufactured as to have a finished bottom face with flanges or shoulders extending outwardly from the periphery of the ceiling panel, and with the bottom face of the ceiling panel being positioned below these outwardly extending flanges such that when the ceiling panel is dropped into position from above within a respective grid opening in the metal grid suspended ceiling system, the ceiling panel would be readily received and supported by the intersection grid members with the bottom faces of all the ceiling panels being substantially coplanar, and with the bottom faces of the grid members appearing as batt members separating adjacent ceiling panels.

It had long been recognized in many commercial buildings that the appearance of such utilitarian ceiling systems utilizing metallic grids resulted in a highly practical ceiling system, but did not enhance the appearance of a room, particularly where an upscale interior finish was desired.

In an effort to enhance the appearance of such metal suspended ceiling grid systems, simulated wood grain risers or grid members were utilized (i.e., metal grid members having a wood grain finish imprinted thereon or adhered thereto was utilized), as shown in U.S. Pat. No. 3,583,119.

It was also known to utilize imitation wood beams, as shown in U.S. Pat. No. 3,557,506, which were fastened to the bottom portions of the conventional metal grid suspended ceiling systems.

Still further, as shown in U.S. Pat. Nos. 4,454,700, 4,281,498, 4,367,616, 4,452,021, 4,464,876, and 4,525,971, a variety of wood beam suspended ceiling systems have been proposed. Typically, like metal grid suspended ceiling systems, these prior art wooden suspended ceiling systems utilized elongate runners with perpendicular cross members. However, these wooden suspended ceiling systems required a variety of metallic clips or other, separate fastening members for rigidly interconnecting the cross members to the runners. Typically, these connecting members were made of metal and were required, either in the field during installation or at the factory prior to installation, to be separately attached to the cross members and to the runners.

SUMMARY OF THE INVENTION

Among the several objects and features of the present invention may be noted the provision of a wooden suspended ceiling system in which the main runners and the cross members are of solid wood construction, and in which the cross members may be positively interlocked with the main runners without the use of auxiliary clips or other fastening devices;

The provision of such a wooden suspended ceiling system which accommodates conventional ceiling panels, with the exposed parts of the wooden ceiling grid system exposed thereby to enhance the aesthetics of the ceiling from within the room;

The provision of such a wooden suspended ceiling system in which the means for interlocking the cross members and the runners are integral with the cross members;

The provision of such a wooden suspended ceiling system which may be readily installed in substantially the same manner as prior metal grid suspended ceiling systems;

The provision of such a wooden suspended ceiling system which may be arranged to accommodate and support conventional lighting fixtures;

The provision of such a wooden suspended ceiling system which, with a minimum amount of cutting, may be adapted to fit within a room of varying dimensions and having irregular walls, internal posts, or columns;

The provision of such a wooden suspended ceiling system in which the cross members also serve as spacers for the main runners;

The provision of such a wooden suspended ceiling system in which crown and cove moldings may be utilized to enhance the treatment of the intersection of the walls and ceiling of a room;

The provision of such a wooden suspended ceiling system which, in place of conventional flat composite ceiling panels, may be utilized in combination with wooden vaulted panels thereby resulting in a wooden vaulted ceiling; and The provision of such a wooden suspended ceiling system which is easy to install, which is of relatively low cost, and which substantially enhances the aesthetic appearance of the ceiling.

Other objects and features of this invention will be in part apparent and in part pointed out hereinafter.

Briefly stated, a wooden suspended ceiling system of the present invention is suspended at a desired level from an overhead structure of a building, such as the bar joists of the roof structure or the immediately adjacent above floor of the building. The suspended ceiling system of the present invention comprises a plurality of parallel wooden runners extending in one direction, and a plurality of parallel wooden cross members supported by the runners and extending in a second direction, thus defining a plurality of openings. A ceiling panel is supported by the runners and cross members and thus closes the ceiling openings. The runners and the cross members each have an upper face and a bottom face, with the latter being viewable from below within the room. The upper face of both the runners and the cross members comprises a central portion, a groove on each side of the central portion, and a lip outboard of the groove, with the inner surface of the lip defining the outer vertical surface of the groove. The vertical surface of each of the lips defines the sides of the runners or cross members. Each of the cross members has an integral hook extending out beyond the end thereof for cooperating with an adjacent side, lip, and groove of its respective runner, thereby to positively interconnect the cross member to the runner and to support the cross member on the runner.

BRIEF DESCRIPTION OF THE DRAWINGS

FIG. 1 is a perspective top view of a wooden suspended ceiling system of the present invention illustrating a plurality of parallel runners and a plurality of cross tees or members perpendicular to the runners defining openings therebetween with the openings being sized to support fluorescent lighting fixtures and ceiling panels, with the runners and cross members defining a wooden grid system suspended from overhead structure of the building by a plurality of suspension wires, with the walls of the room being shown in phantom;

FIG. 2 is an enlarged cross sectional view, taken along line 2—2 of FIG. 1, illustrating, in vertical cross section, two of the parallel runners with a cross tee interconnected therebetween spacing the runners and interlocking them together;

FIG. 3 is a view taken along line 3—3 of FIG. 1, illustrating the preferred manner of positively interconnecting the cross tees to the runners;

FIG. 4 is a vertical cross sectional view taken along line 4—4 of FIG. 1, illustrating a cross tee positively interconnected to a cove molding board proximate the outer margin of the room at the intersection of the ceiling and the top of the wall;

Corresponding reference characters indicate corresponding parts throughout the several views of the drawings.

DESCRIPTION OF PREFERRED EMBODIMENTS

Figure 5:
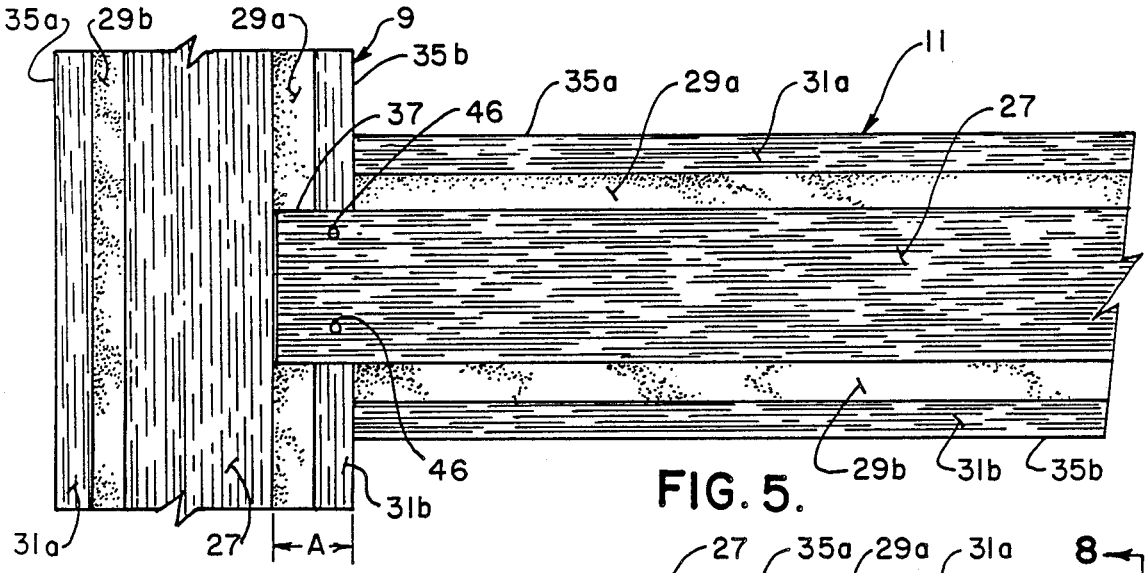
FIG. 5 is a top plan view taken along line 5—5 of FIG. 2, illustrating, in an enlarged scale, the intersection of a main runner and a cross tee, and further illustrating means integral with the cross tee for positively interconnecting the cross tee and the main runner and for supporting the cross tee on the main runner.

Referring now to the drawings, and particularly to FIG. 1, a wooden suspended ceiling system of the present invention is indicated in its entirety by reference character 1. Ceiling system 1 comprises the ceiling C of a room R of a building, which, for example, may be a large office or other commercial building having overhead structure (not shown) above the ceiling system. For example, this overhead building structure (not shown) may comprise a series of overhead horizontal beams or bar joists which support the floor or roof structure thereabove. As is conventional, the wooden suspended ceiling system 1 of the present invention is suspended from the above-described overhead building construction at a desired horizontal level in a manner as will appear Room R further comprises a number of vertical walls or partitions 3 defining rooms within the building, and each room has a floor 5 located below the ceiling C. As indicated at 7, wall 3 has a door located therewithin. Typically, walls or partitions 3 in such commercial buildings are secured to floor 5, but the top portions of the walls need not be positively joined to the suspended ceiling system 1. In fact, in many large office or other commercial buildings, an entire floor (or large portions thereof) are finished by laying carpet or other floor covering material on floor 5 and by installing a complete suspended ceiling system 1 of the present invention throughout a large area of the building prior to constructing walls or partitions 3. It will be understood that oftentimes the location of walls or partitions 3 are at the choice and design of a tenant of the building which is not known at the time the building is completed. By having the ability to erect walls 3 at substantially any location on floor 5 without the necessity of securing the tops of the walls to ceiling system 1 of the present invention, a substantially infinite arrangement of walls and rooms within the building may be readily realized.

Figure 9:
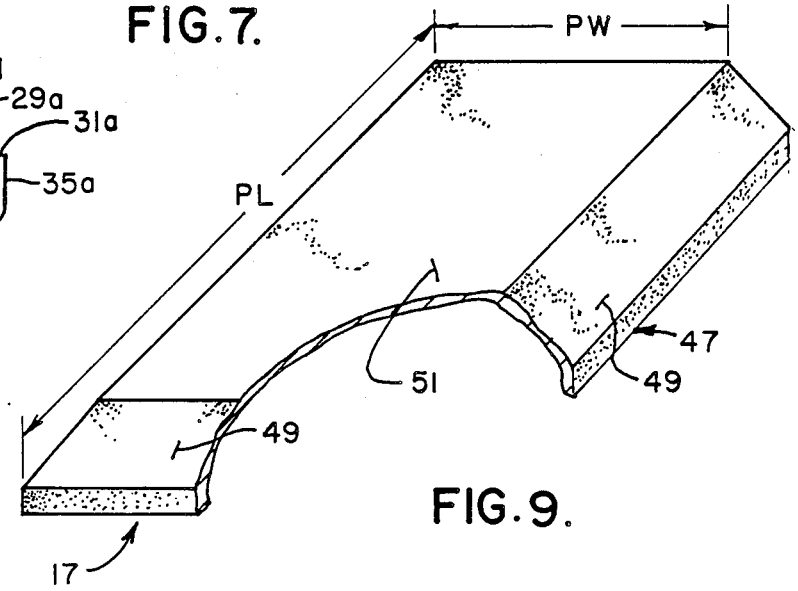
FIG. 9 is a partial broken away perspective view of a vaulted ceiling panel adapted to be dropped into place within a ceiling panel opening defined by a pair of cross members and a pair of main runner members thereby to close off the ceiling panel opening in the wooden suspended ceiling grid system.
Figure 13:
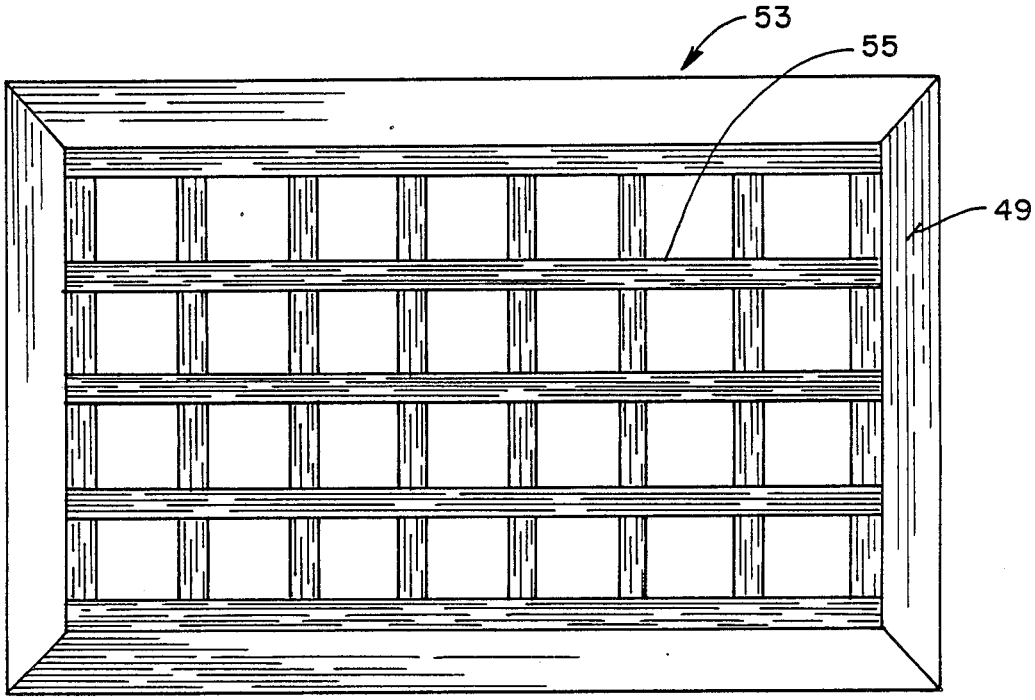
FIG. 13 is a top plan view of another vaulted ceiling panel, similar to that shown in FIG. 9, in which the top panel of the vaulted ceiling panel is of lattice construction thereby to enhance the appearance of the vaulted ceiling system, or to permit lighting fixtures mounted above the lattice top panel of the vaulted ceiling panel to project downwardly into the room.

More specifically, the wooden suspended ceiling system 1 of the present invention comprises a plurality of elongate main runners 9 extending parallel to one another in one direction and a plurality of cross members 11 parallel to one another and being perpendicular to the main runners 9, with the main runners being spaced apart from one another a predetermined distance, and with the cross members 11 also being spaced apart from one another a predetermined distance thereby to form a wooden horizontal grid system, as generally indicated at 12. The cross members 11 include means, as generally indicated at 13, integral with the cross members for positively interconnecting or locking the cross members to the main runners, and for supporting the cross members on the main runners in the above-described grid array 12. In this manner, a pair of adjacent parallel main runners 9 and a pair of parallel adjacent cross members 11, spanning between the above-noted pair of main runners, define a ceiling panel opening, as indicated generally at 15, with the main members being located on centers by a predetermined uniform dimension L, and with the cross members being located relative to one another on centers by a predetermined dimension W. Ceiling panel openings 15 are so sized as to receive a ceiling panel, as generally indicated at 17, so as to close ceiling openings 15. A flat version of ceiling panel 17 is illustrated in FIG. 1. Various vaulted ceiling panels (as will hereinafter be described in detail), are illustrated in FIGS. 9 and 13. As indicated at 18, fluorescent or other types of lighting fixtures may also be inserted in ceiling openings 15 and supported by the wood grid suspended ceiling system of theppresent invention at any desired location within ceiling C.

As indicated generally at 19, means is provided for suspending the grid array 12 of wooden suspended ceiling system 1 of the present invention from the overhead structure (not shown) of the building. More specifically, suspension means 19 is shown to comprise a plurality of screw eyes 21, preferably screwed into the upper face of elongate main runners 9 at spaced locations therealong. The exact spacing and the number of screw eyes required to adequately support the suspended ceiling system 1 of the present invention from the overhead building construction will vary considerably, depending on the size and shape of the room, the type and number of lighting fixtures 18, and the type of ceiling panels 17 to be supported by the suspended ceiling system. In any event, regardless of the number of screw eyes 21 utilized, appropriate suspension wires 23 are affixed to the screw eyes and extend vertically for securement to the above-mentioned overhead structural members of the building (not shown) thereby to support the wooden suspended ceiling system 1 of the present invention.

Figure 6:
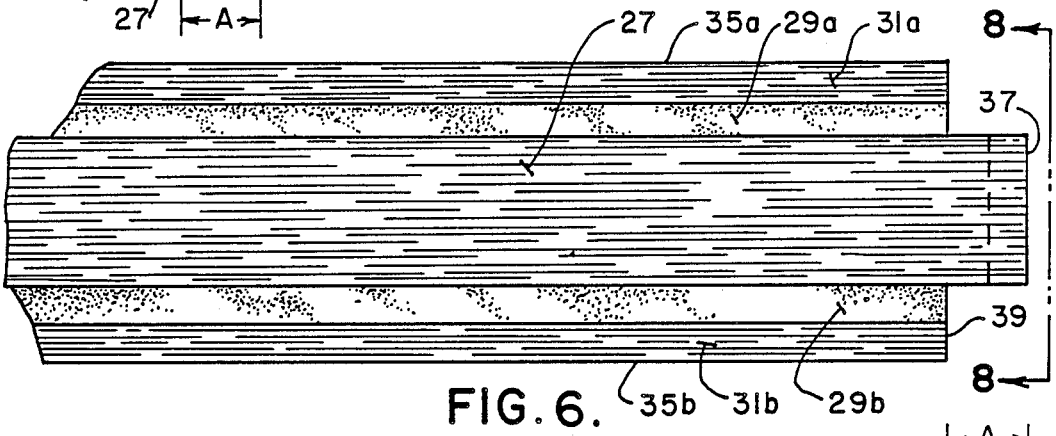
FIG. 6 is a top plan view of one end of a cross tee or cross member, illustrating an integral hook fastener for joining the cross tee to the main runner.
Figure 7:
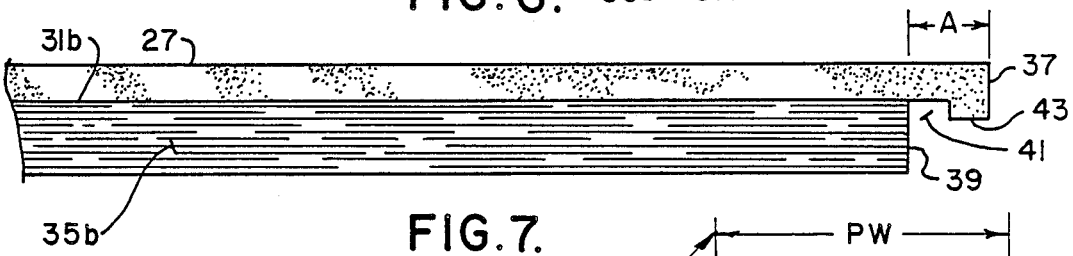
FIG. 7 is a side elevational view of FIG. 6.
Figure 8:
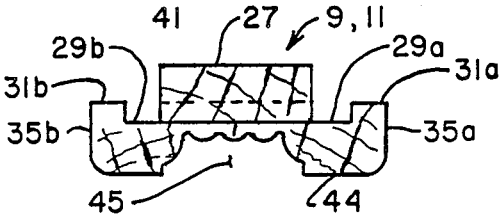
FIG. 8 is an end elevational view of FIG. 6, taken along line 8—8 of FIG. 6.

As above-mentioned, both main runners 9 and cross members 11 are preferably milled of solid wood, such as oak, poplar, walnut, or the like, to a desired shape and have an upper face and a lower face, as shown in FIGS. 2 and 3, with the lower face being viewable from below within room R. As best shown in FIGS. 5–7, each of the wood members has a central sill portion 27 which is centered on and which is generally symetrical with respect to the longitudinal centerline of the main runner 9 or the cross member 11. Further, each of the wooden ceiling grid members has a groove 29*a*, 29*b* on each side of its central sill 27. A lip 31*a*, 31*b* is provided outboard of grooves 29*a*, 29*b*, with the inner face of the lip constituting the outer vertical surface of a respective groove 29*a*, 29*b*. This outer surface of grooves 29*a*, 29*b* is indicated by reference character 33. As noted, the upper horizontal faces of lips 31*a*, 31*b* are spaced below the horizontal surface of central sill 27. The outermost vertical sides 35*a*, 35*b* of each of the wooden members constitute the longitudinal vertical sides of either the main runners 9 or the cross members 11.

As previously indicated, cross members 11 are provided with integral means 13 for positively interconnecting or locking main runners 9 and cross members 11 together. More specifically, this integral locking or holding means 13 is shown to comprise a wooden hook end 37 integrally formed on each end of cross members 11. Hook end 37 is shown, in FIGS. 5–7, to extend out beyond the transverse end 39 of cross member 11 a distance A (as shown in FIG. 7), which is substantially equal to (or slightly less than) the distance from the outer side 35*a*, 35*b* of main runner 9 to the outermost vertical edge of center sill 27, as also indicated by dimension A in FIG. 5. Hook end 37 further comprises a transverse groove 41 (see FIG. 7) formed in the bottom of the hook end 37, with an outermost finger 43 extending downwardly at the outer end of the hook end. It will be appreciated that when the cross member 11 is connected or locked to main runner 9, as shown in FIGS. 2, 3, and 5, finger 43 of integral hook end 37 is received in a respective groove 29*a*, 29*b* of main runner 9, and the upwardly protruding respective lip 31*a*, 31*b* of the main runner is received in transverse groove 41 of hook end 37 of the cross member 11. Further, the transverse end face 39 of cross member 11 is in face-to-face abutting relation with a respective vertical side 35*a*, 35*b* of main runner 9. It will be understood that the tolerances between hook end 37 of cross member 11 and grooves 29*a*, 29*b* and lips 31*a*, 31*b* of main runner 9 are such that the hook end 37 has a relatively tight fit as it is received on the main member, as shown in FIGS. 2, 3, and 5, so as to ensure that the cross members are substantially perpendicular with respect to the main members, and so as to substantially prevent sliding movement of the cross members lengthwise of the main runners. Additionally, with the upper surface of a respective lip 31*a*, 31*b* bearing against the upper horizontal edge defining groove 41 on hook end 37, and with finger 43 protruding down into and being received by the lateral grooves 29*a*, 29*b* of the main runner 9, the weight of the cross members is supported by the main runners at either end of the cross members, as shown in FIG. 2. As is illustrated in FIGS. 2 and 3, with the cross members 11 connected to main runners 9 by hook ends 37, the bottom faces of both the cross members and the main runners are substantially coplanar.

Further, it will be appreciated that a decorative recess 45 may optionally be provided in the bottom face of both main runners 9 and cross members 11 so as to give a sculptured or three-dimensional appearance to a viewer within room R looking upwardly at ceiling 1 of this invention, thus enhancing the visual perception that the wooden suspended ceiling system 1 of the present invention is of solid wood.

It will be appreciated that locking means 13, including hook ends 37, as above-described, snuggly fit with their respective main runners 9 in such manner that the wooden grid system 12 is maintained in its desired grid position, as shown in FIG. 1, with main runners 9 extending parallel to one another in one direction, and with the cross members 11 extending parallel to one another and perpendicular to the main runners in another direction, with the cross members maintaining their predetermined distances therebetween, as indicated by dimension L in FIG. 1, so as to maintain ceiling panel openings 15 of a predetermined size. However, in certain instances, it may be desirable that staples, nails, or other fastening devices, as generally indicated at 46 (see FIG. 5), be driven through the portion of hook end 37 of cross member 11 into the respective upper face of a respective lip 31*a*, 31*b* of main member 9, thereby to positively interconnect and secure the cross members to the main members. Preferably, fasteners 46 are driven through the cross members into the main members by means of a pneumatic nailing device (not shown) familiar to those skilled in the art such that substantially no momentum or impact force is applied to either the cross members or the main runners, as may be caused by driving nails 46 into the wood members with a hammer.

To install the wood grid system 12 of the suspended ceiling system of the present invention, the room in which it is to be installed is first carefully measured and the grid pattern is layed out so as to allow the spaces at the edges of the room to be substantially equal. It is preferred that the overhead building structure from which the suspended ceiling grid 12 is to be suspended (i.e., bar joists) run perpendicular to the direction of main runners 9. The reason for this is that upon attaching suspension wires 23 to the main members, the suspension wires will have a greater tendency to run truly perpendicular from the main members to the building support structure (e.g., bar joists), and thus will not apply side loads to the ceiling grid system. The main members 9 are suspended from the overhead building structure utilizing screw eyes 21 and suspending wires 23, and are arranged at their desired spacing W, as shown in FIG. 1, preferably by using cross members 11 as spacing guides. With the main members 11 thus suspended from the overhead building structure, and with all of the main members 9 being substantially at their desired horizontal position, cross members 11 are manually installed between the main members at their desired spacing from one another in the manner shown in FIG. 2. It will be understood that the cross members 11 may be manually pressed into locking engagement with the main members, utilizing the integral hook ends 37 on the cross members being received in side grooves 29*a*, 29*b* of the main members. As above described, optional, but in certain instances preferable, nails 46 may be driven into the cross members and into the main members (as shown in FIG. 5) thereby to even more securely join the cross members to the main members when the cross members and the main members have been accurately positioned with respect to one another.

After completion of installation of the grid system 12, appropriate ceiling panels 17 and lighting fixtures 18 may be inserted in place from above such that the edges of the ceiling panels and edges of the lighting fixtures are supported on the upper faces of lips 31*a*, 31*b* of both the main runners and the cross members.

Referring now to FIG. 9, another embodiment of a ceiling panel is shown, indicated in its entirety at reference character 47. More specifically, ceiling panel 47 is a so-called vaulted or three-dimensional ceiling panel, having an outer peripheral frame comprising inclined cove molding wood members 49 with miter cut corners such that the sides of vaulted ceiling panel 47 have a lower vertical outer portion and an upwardly, inwardly inclined outer portion with a decorative molded inner face. On the upper edges of the mitered cove molded sides of the vaulted ceiling panel, a flat upper panel 51 is secured thereto. Preferably, the sides and upper panel 51 of vaulted ceiling panel 47 are made of solid wood and are conventionally finished. Vaulted ceiling panel 47 is sized so as to be lowered into place within a respective ceiling panel opening 15 within ceiling grid system 12 in place of the flat or planar ceiling panels 17, as illustrated in FIG. 1. Thus, the ceiling system 1 of the present invention utilizing vaulted ceiling panels 47 gives a distinctively different appearance to viewers within room R, and adds appreciably to the aesthetics of the ceiling. Of course, it will be recognized that lighting fixtures 18 may be installed at desired locations within grid system 12 in the manner heretofore described.

Referring to FIG. 13, still another embodiment of a ceiling panel is illustrated in its entirety as reference character 53. Ceiling panel 53 is a vaulted ceiling panel, similar to vaulted ceiling panel 47, with the exception that upper panel 51 of ceiling panel 47 has been replaced by a wooden lattice upper panel member 55. This gives yet another aesthetically different appearance.

Referring to FIG. 1, it will be appreciated that in certain applications, it is necessary to treat the intersection of wooden suspended ceiling system 1 and the vertical upper reaches of walls 3 in such a manner that the ends of the main runner members 9 and the outer ends of the cross members 11 are adequately supported, and yet such that ceiling openings 15 at the edges of the room may be varied in the event the room is not of such dimensions that an even number of full size ceiling panels, either in length or width, can be accommodated. To accomplish this, a variety of molding members, as illustrated in FIGS. 10, 11, and 4, may be utilized at the intersection of ceiling system 1 in the upper reaches of walls 3.

Figure 10:
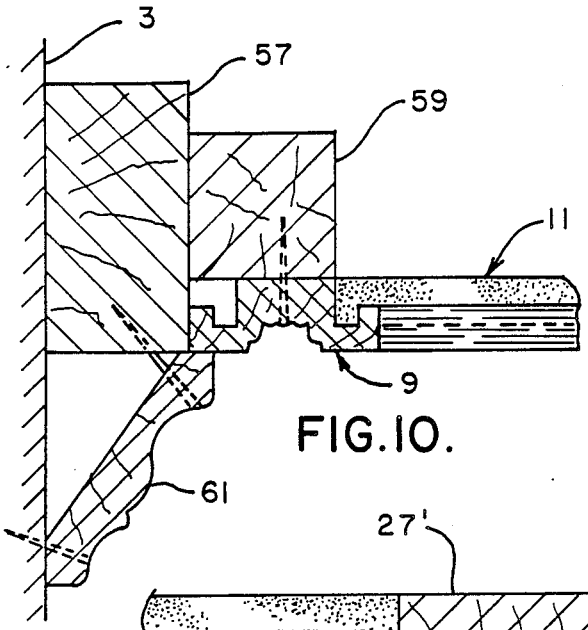
FIG. 10 is a vertical cross sectional view illustrating the construction details of one manner in which the suspended ceiling system of the present invention may be treated at the intersection of the ceiling and the wall, utilizing a crown mold.

More particularly, referring to FIG. 10, one manner of supporting the ends of ceiling system 1 is shown in which an elongate nailing block 57, typically of 2×3 lumber or the like, is secured, as by means of nails or the like, to wall 3 at a prescribed elevation above floor 5. A firring strip 59 is secured to nailing block 57, and an appropriate main runner 9 for a prescribed length thereof is nailed to the bottom face of firring strip 59 such that the innermost vertical edge of firring strip 59 is in vertical alignment with the outermost edge of central portion 27 of runner member 9 nailed to the firring strip such that the hook end 37 of cross members 11 may be secured thereto thereby to support the outer ends of the outermost cross tees 11. Further, a crown molding strip 61 may be nailed at an incline with respect to wall 3 and the bottom faces of nailer 57 and main runner 9 so as to give a finished crown molding appearance to the room at the intersection of ceiling C and wall 3.

Figure 11:
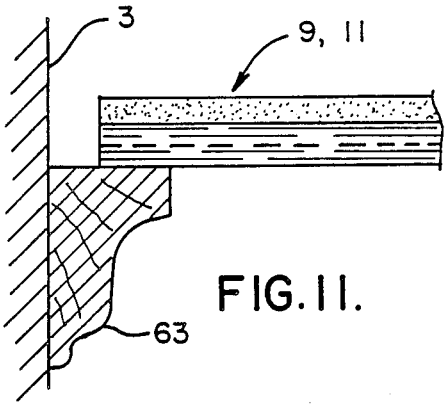
FIG. 11 is a view similar to FIG. 10 utilizing a panel mold cove to support the ends of the runners or cross tees which are cut to a desired length thereby to conform to the dimensions of the room in which they are installed.

Referring now to FIG. 11, another variation of the molding treatment utilized to support the outer ends of ceiling system 1 of the present invention, is shown in which lengths of panel mold cove strips 63 are secured (nailed) to wall 3 at a predetermined elevation around the room. In this manner, runners 9 and cross tees 11 may be cut to a desired length so as to accommodate variations in room size in the event full size ceiling panel openings 15 cannot be accommodated at the edges of the room. In this manner, the ends of the cut-to-length main runners 9 and cross tees 11 rest on the upper surfaces of the mold cove strips 63, and thus the outer edges of ceiling system 1 are supported. Of course, the outer edges of these main members and cross tees may be positively secured to cove molding strips 63 by means of nails 46, as heretofore described in regard to FIGS. 3 and 5.

In FIGS. 1 and 4, a cove board 65 is provided at the outer edges of ceiling 1 such that the hook ends 37 of cross members 11 may be hooked thereto in the manner described above.

Figure 12:
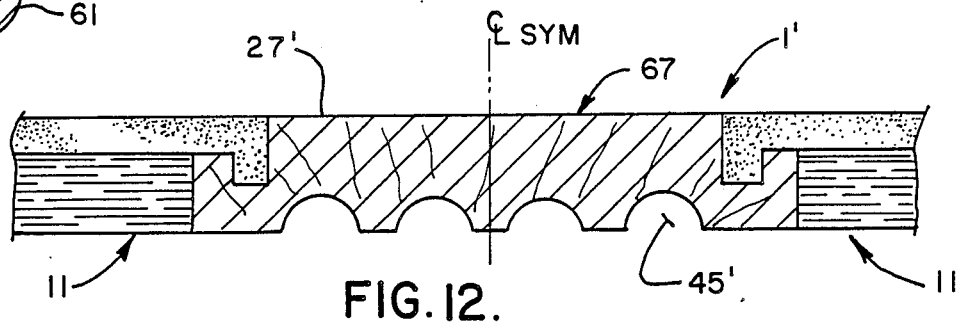
FIG. 12 is a cross sectional view illustrating a fluted beam which constitutes a main runner in another embodiment of the wooden suspended ceiling system of the present invention, with the fluted beam having cross members secured thereto and supported thereby, and with the fluted beam giving the appearance of a wide longitudinal beam extending lengthwise of the ceiling.

Referring to FIG. 12, another variation of the wooden suspended ceiling system 1 of the present invention, as indicated in its entirety by reference character 1', may be utilized in which relatively wide, fluted solid wood beams 67 are substituted for main runners 9 heretofore described. Fluted beams 67 are essentially identical to main members 9, except that the width of the central portion 27' of the fluted beams is substantially wider than the central portion 27 of main runners 9. Additionally, the decorative recess 45', shown in the bottom face of the fluted beam, comprises four longitudinal, circular cross sectional grooves in place of the compound recess 45' provided in main members 45. It will be appreciated that the primary reason for using a wider fluted beam 47 in place of main runners 9 is that there will be a variation in width between the main runner fluted beams 47 and the width of cross tees 11 in ceiling system 1 thereby to give a different architectural or aesthetic appearance to the ceiling system 1' of the present invention.

While the ceiling system shown herein illustrates the runners 9 and cross member 11 being perpendicular to one another and defining rectangular ceiling openings 15, those skilled in the art will recognize that the runners and the cross members can be at angles relative to one another other than perpendicular such that other shaped openings (i.e., traingular or other shapes) may be formed.

In view of the above, it will be seen that the other objects of this invention are achieved and other advantageous results obtained.

As various changes could be made in the above constructions or method without departing from the scope of the invention, it is intended that all matter contained in tne above description or shown in the accompanying drawing shall be interpreted as illustrative and not in a limiting sense.

What is claimed is:

1. A wooden suspended ceiling system suspended at a desired level from the overhead structure of a building, said system comprising a plurality of one-piece, integral wooden runners extending in one direction, and a plurality of one-piece, integral wooden cross members supported by said runners and extending in a second direction relative to said runners thus defining a plurality of openings, a plurality of ceiling panels supported by said runners and said cross members with said ceiling panels closing said openings, said runners and cross members having an upper face and a bottom face, with the bottom faces thereof being viewable from below, said upper face of both said runner and said cross members comprising a central sill portion, a longitudinal groove on the sides of said central sill portion of the runners, a lip outboard of said grooves with the inner surfaces of said lips defining the outer surfaces of said grooves, and with the outer vertical surfaces of said central portions defining the inner surfaces of said grooves, the outer surface of each said lips defining the outermost sides of said runners, said cross members having integral wooden means extending out beyond the end thereof for cooperating with an adjacent side, lip, and groove of a respective said runner thereby to positively interconnect said cross member to said runner and to support said cross member on said runner.

2. A wooden suspended ceiling system as set forth in claim 1 wherein said runner and cross members are of substantially the same cross section.

3. A wooden suspended ceiling system as set forth in claim 1 wherein said integral interconnecting means comprises an integral hook portion of said central portion of said cross member extending endwise out beyond the end of said cross member a distance substantially equal to the distance from the outer side of said runner to the vertical side of said central portion of said runner, said cross member hook portion having a transverse groove in the bottom face thereof for receiving said lip of said runner, and a downwardly extending finger for being received in a respective said groove of said runner.

4. A wooden suspended ceiling system as set forth in claim 3 further comprising fastener means interconnecting said hook portion to said runner.

5. A wooden suspended ceiling system as set forth in claim 1 wherein said bottom face of said runner and said cross member has a decorative recess therein for accentuating the visual depth of said runners and said cross members when viewed from below.

6. A wooden suspended ceiling system as set forth in claim 5, wherein said decorative recess extends transversely of said runner and cross member a distance greater than the width of said central portion such that said decorative recess extends entirely across said central portion and at least in part across said lips on each side of said central portion.

7. A wooden suspended ceiling system as set forth in claim 1 further comprising molding means at the intersection of said ceiling system and the upper reaches of the vertical walls of a room for accommodating and for supporting the outermost ends of said runners and cross members.

8. A wooden suspended ceiling system as set forth in claim 7 wherein said molding means comprises a horizontal molding member secured to said wall having an upper face coplanar with the bottom faces of said members and cross members for supporting the latter relative to said wall.

9. A wooden suspended ceiling system as set forth in claim 1 wherein said ceiling panel is a vaulted panel having a central recess therein at or above the level of said upper surfaces of said runners and cross members.

10. A wooden suspended ceiling system as set forth in claim 9 wherein said vaulted panels comprise a rectangular frame with mitered corners of a suitable crown molding having a bottom horizontal surface, a downwardly facing inner surface inclined upwardly and inwardly from said bottom surface of said vaulted panel to a generally horizontal upper surface, said vaulted panel having a central panel secured to the upper surfaces of said frame, with said bottom horizontal surfaces of said frame bearing upon the upwardly facing lip surfaces of said cross members and said runners defining a ceiling panel opening within said ceiling panel system.

11. A wooden suspended ceiling as set forth in claim 9 wherein said central panel of said vaulted ceiling panel is of lattice construction.

* * * * *